United States Patent [19]

Takagi

[11] Patent Number: 4,734,354

[45] Date of Patent: Mar. 29, 1988

[54] FLUORESCENT BRIGHTENER IN IMAGE-RECEIVING MATERIAL FOR SILVER SALT DIFFUSION TRANSFER PROCESS

[75] Inventor: Yoshihiro Takagi, Kanagawa, Japan

[73] Assignee: Fuji Photo Film Co., Ltd., Kanagawa, Japan

[21] Appl. No.: 885,398

[22] Filed: Jul. 18, 1986

Related U.S. Application Data

[63] Continuation of Ser. No. 702,563, Feb. 19, 1985, abandoned.

[30] Foreign Application Priority Data

Feb. 16, 1984 [JP] Japan ..... 59-27664

[51] Int. Cl.[4] ..... G03C 5/54

[52] U.S. Cl. ..... 430/247; 430/227; 430/232; 430/233; 430/249; 430/487; 430/933

[58] Field of Search ..... 430/227, 232, 233, 933, 430/243, 249, 244, 487

[56] References Cited

U.S. PATENT DOCUMENTS

| | | | |
|---|---|---|---|
| 3,779,766 | 12/1973 | Tsuji et al. | 430/227 |
| 4,115,124 | 9/1978 | Hamilton et al. | 430/933 |
| 4,298,673 | 11/1981 | Kubotera et al. | 430/487 |
| 4,368,811 | 12/1982 | Iguchi et al. | 430/251 |
| 4,568,634 | 2/1986 | Hayashi et al. | 430/249 |

*Primary Examiner*—Richard L. Schilling

*Attorney, Agent, or Firm*—Sughrue, Mion, Zinn, Macpeak and Seas

[57] ABSTRACT

An image-receiving material for a silver salt diffusion transfer process is described, comprising a support having provided thereon an image-receiving layer containing physical development nuclei, wherein the image-receiving layer contains gelatin, a water-soluble fluorescent brightening agent, and a water-soluble vinyl polymer, wherein the weight ratio of the water-soluble fluorescent brightening agent to the gelatin ranges from about 0.02/1 to about 0.5/1 and the weight ratio of the water-soluble vinyl polymer to the water-soluble fluorescent brightening agent ranges from about 0.1/1 to 5/1.

14 Claims, No Drawings

FLUORESCENT BRIGHTENER IN IMAGE-RECEIVING MATERIAL FOR SILVER SALT DIFFUSION TRANSFER PROCESS

This is a continuation of application Ser. No. 702,563 filed Feb. 19, 1985, now abandoned.

FIELD OF THE INVENTION

This invention relates to an image-receiving material for a silver salt diffusion transfer process, and, more particularly, to an image-receiving material for a silver salt diffusion transfer process having improved whiteness.

BACKGROUND OF THE INVENTION

It is well known to use a fluorescent brightening agent in order to heighten whiteness of the background of silver halide photographic materials after processing. A fluorescent brightening agent absorbs ultraviolet rays and generally fluoresces a light blue color, to thereby impart apparent whiteness to an object.

Such a whitening method conventionally includes a method of adding a fluorescent brightening agent to a paper support or a polyolefin layer of the paper support, a method of adding a water-soluble or oil-soluble fluorescent brightening agent to a silver halide emulsion layer or other photographic coating layers, and a method of previously adding a fluorescent brightening agent to a developing solution. However, incorporation of the fluorescent brightening agent into a laminate layer of a polyethylene laminate paper is disadvantageous in that the fluorescent brightening agent is apt to decompose due to its poor heat stability during heat-extrusion for lamination. Further, attempts to impart fluorescent whiteness during development procesing by the addition of the fluorescent brightening agent to a developing solution are disadvantageous since uniformity in quality of the final product cannot be maintained unless the concentration of such a fluorescent brightening agent is maintained constant throughout the developing processing.

When considering incorporation of a fluorescent brightening agent in an image-receiving layer of an image-receiving material, it is more effective to use an oil-soluble fluorescent brightening agent rather than a water-soluble fluorescent brightening agent, from the viewpoint of preventing the agent from running out during processing or washing with water. To achieve this effect, a method has been proposed in which an oil-soluble fluorescent brightening agent is dissolved in an organic solvent to obtain an emulsified dispersion and the dispersion is added to the gelatin layer, as disclosed, e.g., in British Pat. No. 1,072,915. However, this proposal still has disadvantages, such as that incorporation of such an emulsified dispersion in an image-receiving layer results in reduction of transferred density, or fluorescence is quenched to lose the whitening effect when the image-receiving material is treated with a processing solution containing an amine compound.

On the other hand, in the case where a water-soluble fluorescent brightening agent is incorporated in an image-receiving layer, particularly when the proportion of the water-soluble fluorescent brightening agent to gelatin in the image-receiving layer is great, it was found that not only does the fluorescent brightening agent easily escape from the image-receiving layer during processing and washing with water, but also introduction of the agent reduces the transferred density.

Further, even if a fluorescent brightening agent is introduced in an image-receiving layer, treatment with a processing composition containing an amine compound quenches the fluorescence to destroy the whitening effect.

It is an important requirement for a fluorescent brightening agent not to escape during washing with water, taking into account that an image-receiving material, after processing, is washed with water for a period as long as 5 to 10 minutes in many cases.

Accordingly, it has been strongly desired to develop a method of whitening an image-receiving material which does not lose its whitening effect during development processing or washing with water and also is not accompanied by a reduction of transferred density. Moreover, a method for improving the whiteness of an image-receiving material has been keenly desired in a diffusion transfer process wherein a processing solution containing an amine compound is used.

SUMMARY OF THE INVENTION

An object of this invention is to provide a image-receiving material having improved whiteness.

Another object of this invention is to provide an image-receiving material for a silver salt diffusion transfer process, which can provide an increased transferred density.

Still another object of this invention is to provide a methiod for improving whiteness of an image-receiving material for a diffusion transfer process wherein a processing solution containing an amine compound is used.

These objects of this invention can be accomplished by an image-receiving material for a silver salt diffusion transfer process comprising an image-receiving layer containing physical development nuclei, wherein the image-receiving layer contains gelatin, a water-soluble fluorescent brightening agent, and a water-soluble vinyl polymer, wherein the weight ratio of the water-soluble fluorescent brightening agent to the gelatin ranges from about 0.02/1 to about 0.5/1, and the weight ratio of the water-soluble vinyl polymer to the water-soluble fluorescent brightening agent ranges from about 0.1/1 to about 5/1.

DETAILED DESCRIPTION OF THE INVENTION

The water-soluble vinyl polymer which can be used in the present invention includes water-soluble polymers comprising a repeating unit, such as vinylpyrrolidone, vinyl alcohol,

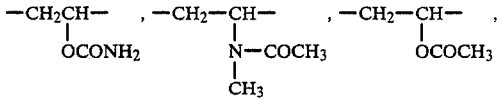

etc., and specifically includes polyvinylpyrrolidone, a copolymer of vinylpyrrolidone and vinyl acetate, a copolymer of

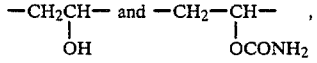

and the like, with polyvinylpyrrolidone being preferred. The average molecular weight of the water-soluble vinyl polymer, particularly polyvinylpyrrolidone, is an important factor in achieving the objects of the present invention, since interaction between the polymer and the water-soluble fluorescent brightening agent varies depending on the average molecular weight of the polymer. Vinyl polymers having too low molecular weights cannot exert their full effect as hereinafter described. Therefore, the average molecular weight of the above-described vinyl polymer preferably ranges from about 10,000 to 450,000, more preferably from about 50,000 to 450,000, and most preferably from about 100,000 to 450,000.

The weight ratio of the above-described polyvinylpyrrolidone to the water-soluble fluorescent brightening agent preferably ranges from about 0.5 to about 3.

The aforesaid water-soluble vinyl polymers are described, e.g., in British Pat. No. 967,891, U.S. Pat. No. 3,666,470 and Japanese Patent Publication Nos. 7127/59 and 49028/72, etc., and they can be synthesized according to methods described in the above-recited references.

In the present invention, the weight ratio of the water-soluble fluorescent brightening agent to gelatin is in the range of from about 0.02/1 to about 0.3/1. The weight ratio of the water-soluble vinyl polymer to the water-soluble fluorescent brightening agent is in the range of from about 0.1/1 to about 5/1, and preferably is from about 0.5/1 to about 3/1.

Any conventional water-soluble fluorescent brightening agents capable of fluorescing a purple to blue color upon absorbing ultraviolet rays can be used in the present invention. Known direct fluorescent brightening agents include stilbene derivatives, diphenyl derivatives, benzidine derivatives, benzoxazole derivatives, benzimidazole derivatives, and the like. These known fluorescent brightening agents can be used in the present invention to advantage.

In particular, compounds represented by formulae (I) to (III) are preferably used as the fluorescent brightening agents.

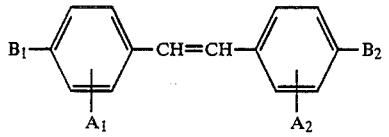

(I)

In formula (I), $A_1$ and $A_2$ each represents a hydrogen atom, a lower alkyl group, a hydroxyl group, a carboxyl group or a salt thereof, or a sulfonic acid group or a salt thereof, and $B_1$ and $B_2$ each represents a hydrogen atom, a group of the formula

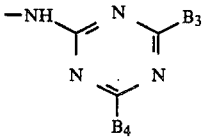

wherein $B_3$ and $B_4$ each represents a hydrogen atom, a hydroxyl group, a lower alkoxy group, an aryloxy group, a heterocyclic group, a lower alkylthio group, an arylthio group, a thioheterocyclic group, or a substituted or unsubstituted amino group wherein the substituent is a sulfoalkyl group, a sulfoaryl group or a hydroxyalkyl group, a group of the formula —$NHCOB_5$, wherein $B_5$ represents a lower alkoxy group, a substituted or unsubstituted aryl group wherein the substituent is an amino group or an alkoxy group, an aryloxy group, a heterocyclic group, a lower alkylthio group, a thioheterocyclic group, or a substituted or unsubstituted amino group wherein the substituent is an aryl group, or a group of the formula

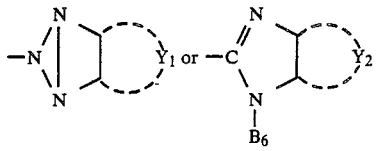

wherein $Y_1$ and $Y_2$ each represents a non-metallic atomic group forming a substituted or unsubstituted aromatic ring wherein the substituent is a sulfo group, a hydroxyl group or an alkyl group, and $B_6$ represents a hydrogen atom or a substituted or unsubstituted lower alkyl group wherein the substituent is a hydroxyl group.

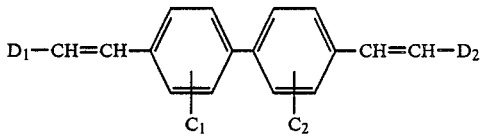

(II)

In formula (II), $C_1$ and $C_2$ each represents a hydrogen atom, a lower alkyl group, a lower alkoxy group, a halogen atom, a sulfonic acid group or a salt thereof, or a carboxyl group or a salt thereof, and $D_1$ and $D_2$ each represents a substituted or unsubstituted diphenyl group wherein the substituent is a sulfo group, an $\alpha$-naphthyl group, a $\beta$-naphthyl group, or a group of the formula

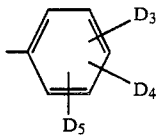

wherein $D_3$ represents a hydrogen atom, a sulfonic acid group or a salt thereof, or a carboxyl group or a salt thereof, $D_4$ represents a hydrogen atom, a halogen atom, a lower alkyl group, or a lower alkoxy group, and $D_5$ represents a hydrogen atom, or a lower alkyl group.

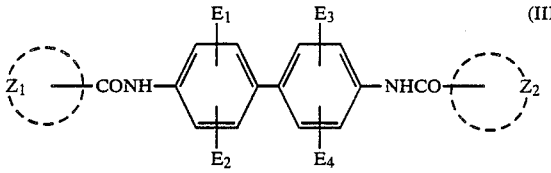

(III)

In formula (III), $E_1$, $E_2$, $E_3$, and $E_4$ each represents a hydrogen atom, a halogen atom, a hydroxyl group, a carboxyl group or a salt thereof, a sulfonic acid group or a salt thereof, a lower alkyl group, or a lower alkoxy group, and $Z_1$ and $Z_2$ each represents a non-metallic atomic group forming a substituted or unsubstituted aromatic ring wherein the substituent is a hydroxyl group, a sulfo group, a carboxyl group or an alkoxy group.

Among the compounds represented by the above-described formula (I), preferred are those represented by formulae (IV) and (V).

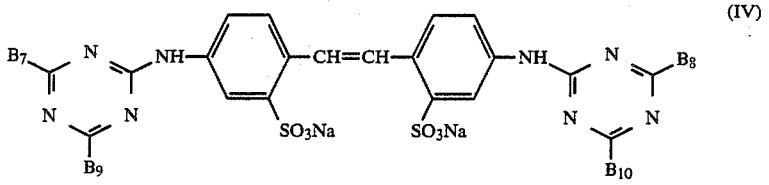

(IV)

In formula (IV), $B_7$, $B_8$, $B_9$ and $B_{10}$ each represents $-NHC_6H_5$, $-NHC_6H_5SO_3Na$, $-OH$, $-NH_2$, $-NHCH_2CH_2SO_3Na$, $-OCH_2CH_3OH$, or $-OCH_3$.

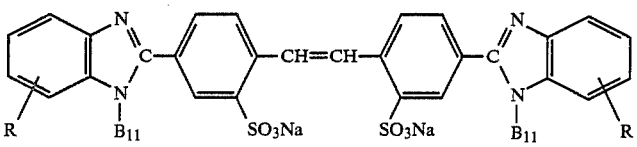

(V)

In formula (V), R represents $-H$, $-CH_3$, $-C_2H_5$, $-OCH_3$, or $-SO_3Na$, and $B_{11}$ represents $-H$, $-CH_3$, or $-CH_2CH_2OH$.

Among the compounds represented by the above-described formula (III), preferred are those compounds represented by formula (VI).

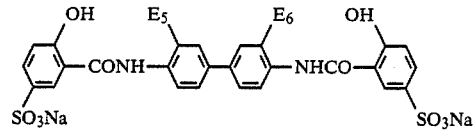

(VI)

In formula (VI), $E_5$ and $E_6$ each represents $-H$, $-CH_3$, or $-OCH_3$.

Of these compounds, those represented by formula (IV) are particularly preferred as the water-soluble fluorescent brightening agents of the present invention.

Specific examples of the water-soluble fluorescent brightening agents which can be used in the present invention are shown below, but it should be understood that these examples are not limiting the present invention.

1.

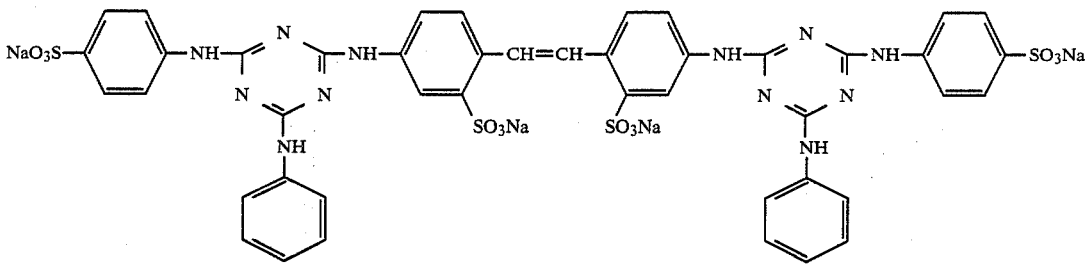

2.

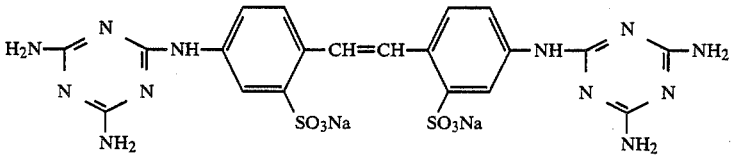

3.

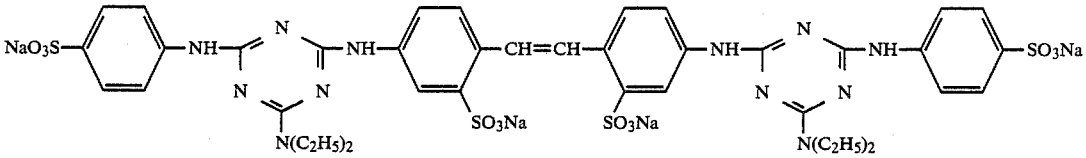

4.

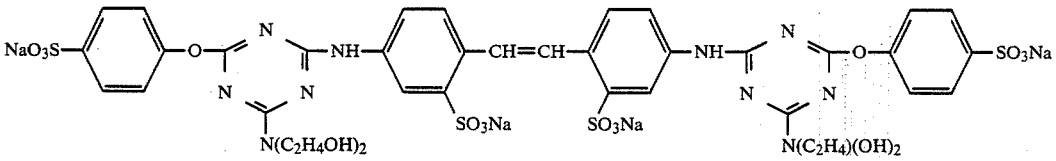

-continued
5.
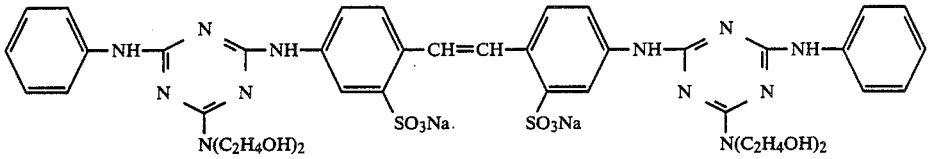
6.
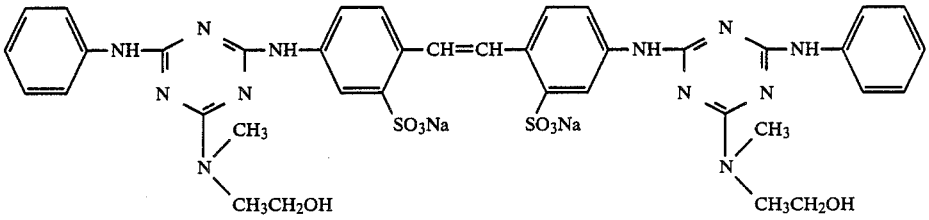
7.
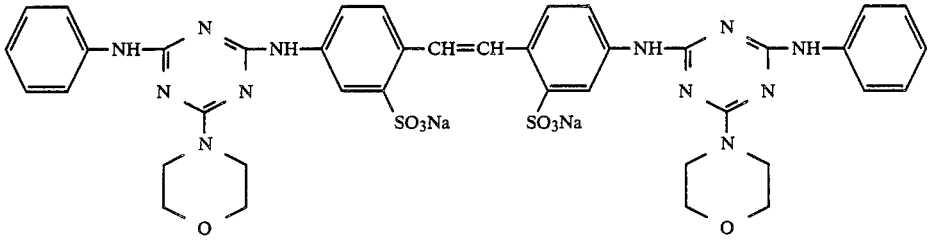
8.
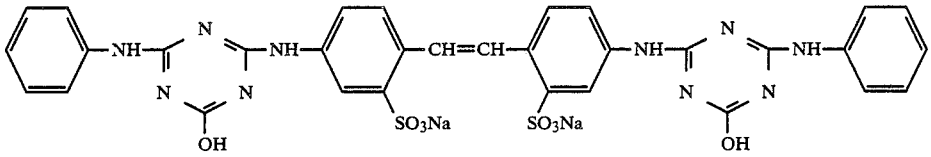
9.
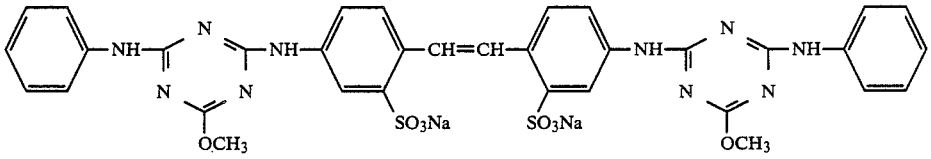
10.
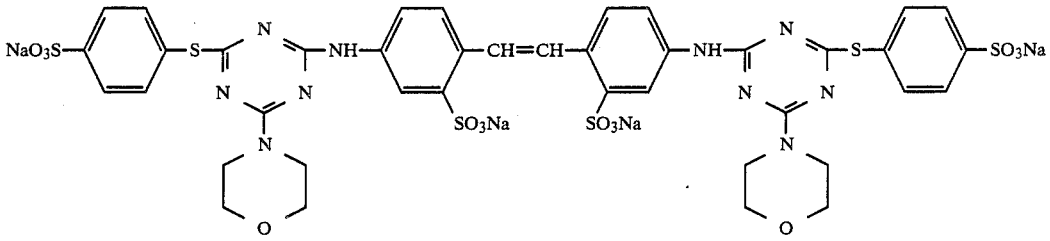
11.
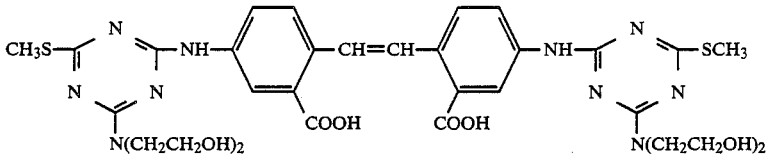
12.
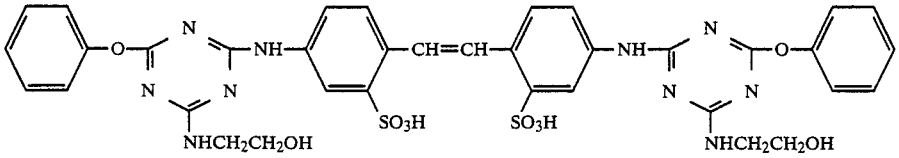

-continued
13.
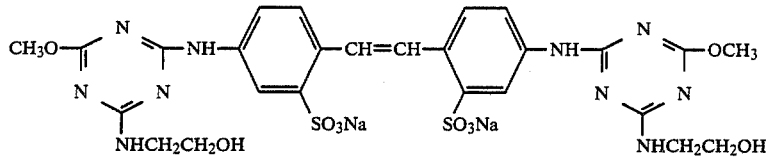
14.
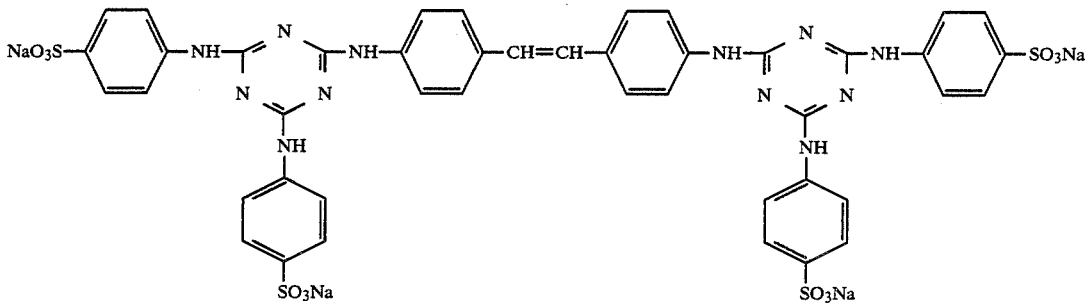
15.
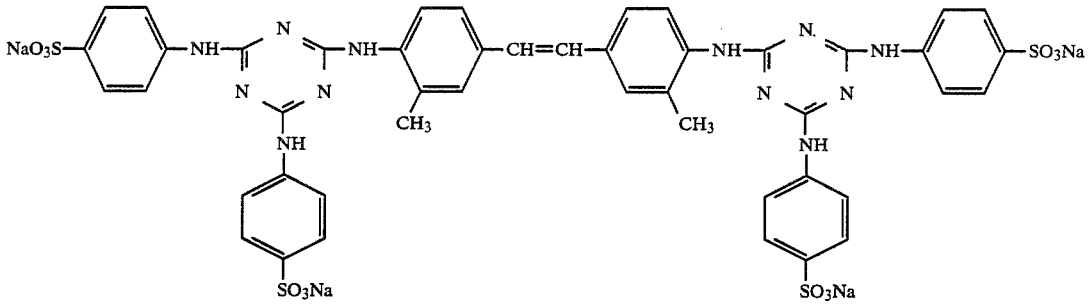
16.
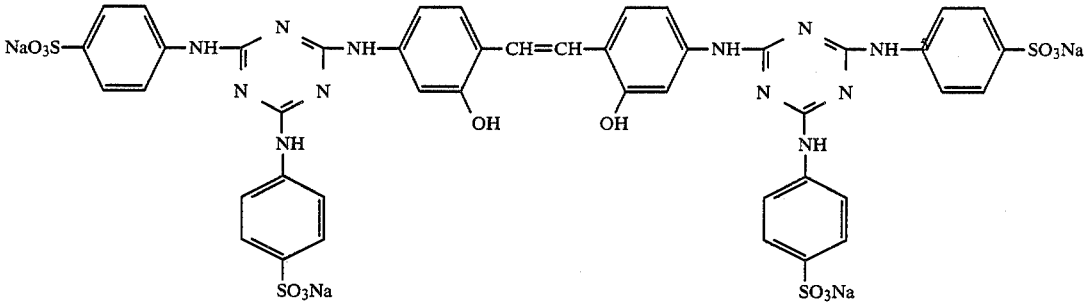
17.
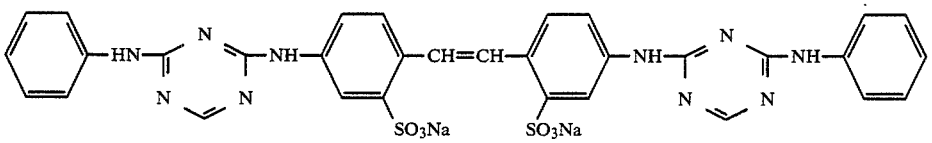
18.
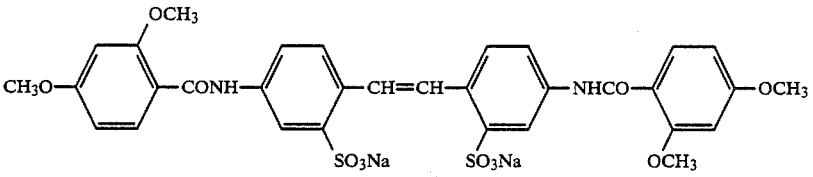
19.
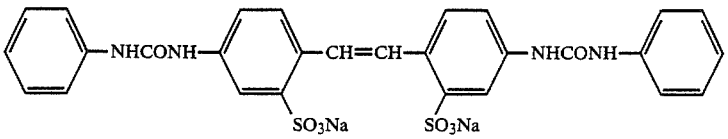

-continued
20.
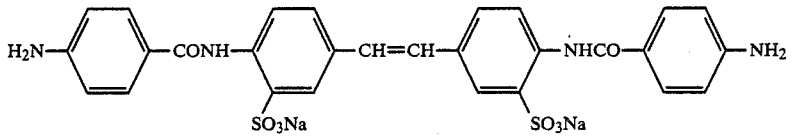
21.
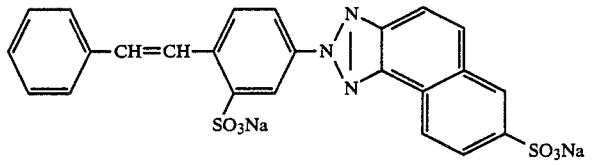
22.
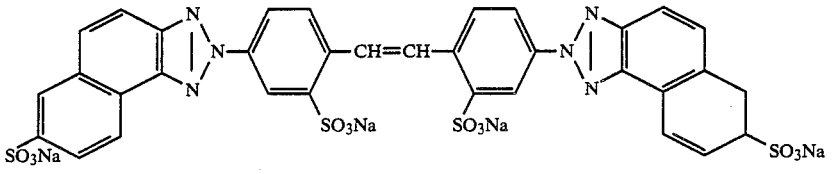
23.
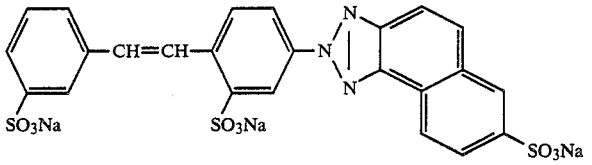
24.
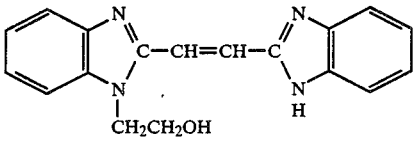
25.
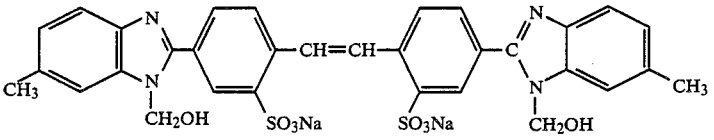
26.
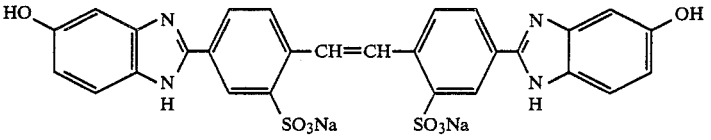
27.
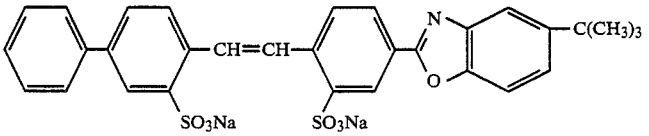
28.
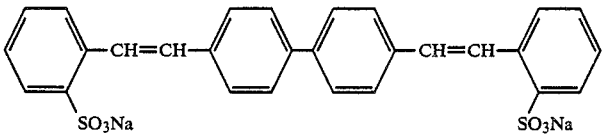
29.
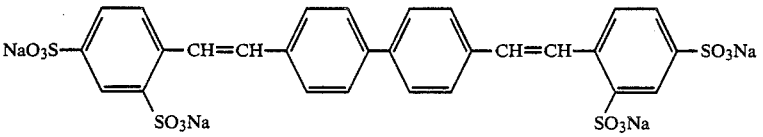

-continued
30.
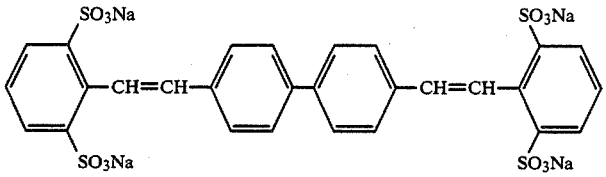
31.
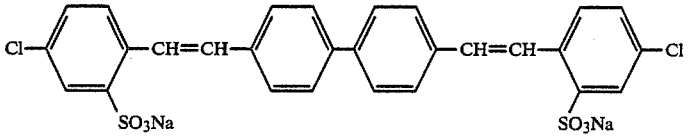
32.
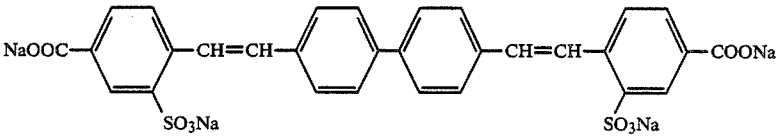
33.
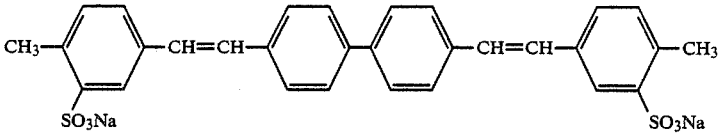
34.
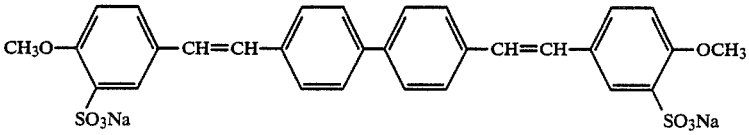
35.
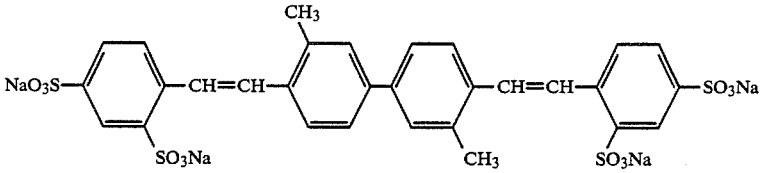
36.
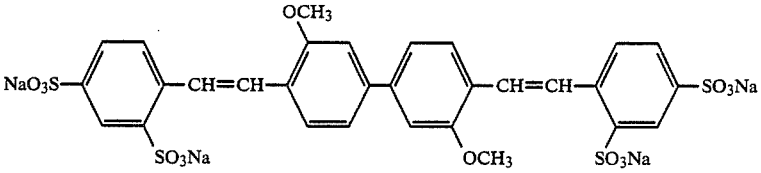
37.
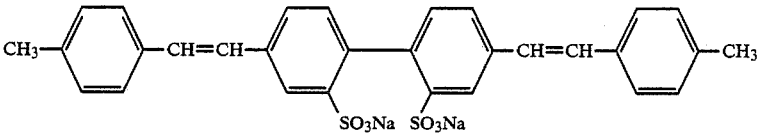
38.
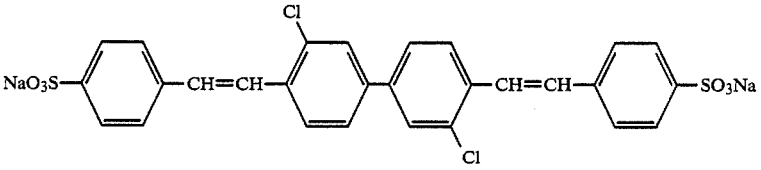

-continued
39.
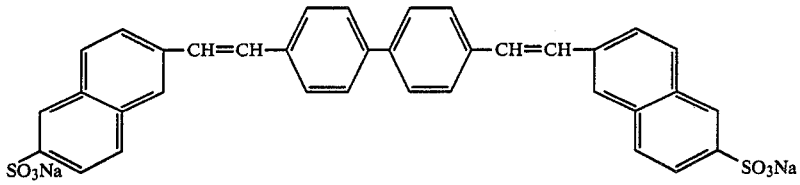
40.
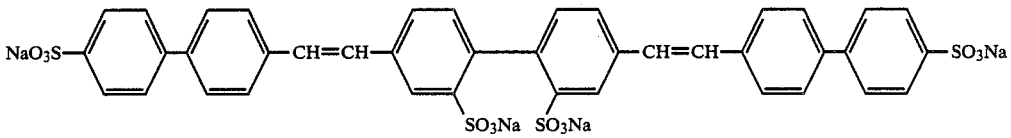
41.
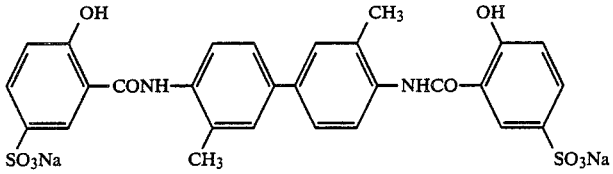
42.
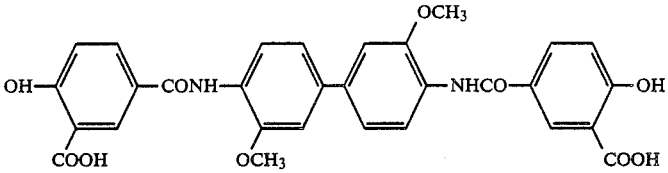
43.
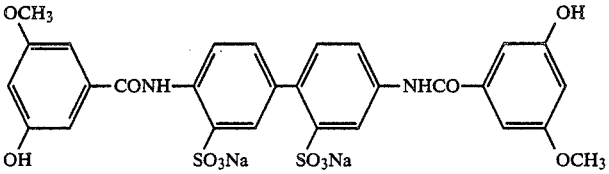
44.
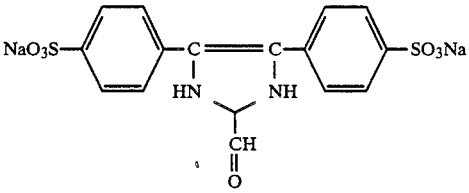
45.
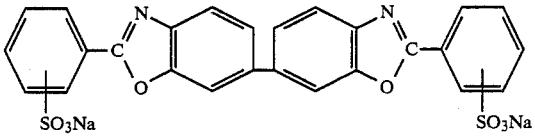
46.
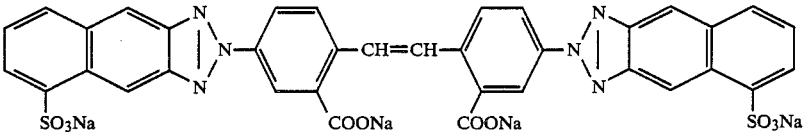
47.
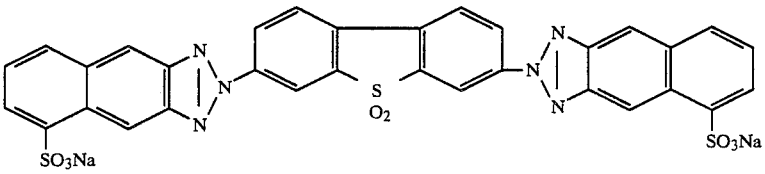
These water-soluble fluorescent brightening agents are well known in the art. They can easily be synthe- Further, some of these water-soluble fluorescent brightening agents are commercially available. Examples of such fluorescent brightening agents include products sold under the following trademarks: WHITEX PA Conc, BF Conc, BO Conc, BK, BB, BRF, 3B, BN Conc, SF Conc, BWB, RG and RP, produced by Sumitomo Chemical Company, Ltd.; KAYAPHOR B Conc, FB Conc, 3BS, AS Conc, A Conc, CR Conc, PAS Conc, SN, BR, PS, MIKAWHITE ATN Conc, ACR Liquid, and KTN Conc, produced by Nippon Kayaku Co., Ltd.; KAYKOL BB, BI, BU, BZ, BA, BX, BRA, 3BL, and PAN, produced by Nisso Kako Co., Ltd.; MIKEPHOR BS Conc, BA Conc, BX, BP Conc, BI Conc, BM Conc, BF Conc, BN, MX Conc, and RFA Conc, produced by Mitsui Toatsu Chemicals Inc.; HAKKOR BX Conc, H, SP, SN, AE, AF, and WG, produced by Showa Kagaku KK; and TINOPAL MSP and STP, produced by Ciba-Geigy A.G.

An embodiment in which the image-receiving material of the present invention can advantageously be used comprises superposing a light-sensitive material containing a silver halide photographic emulsion layer with an image-receiving material in accordance with the present invention and spreading a processing solution for a diffusion transfer process therebetween.

In a more preferred embodiment, the light-sensitive material comprises a support having formed thereon an antihalation layer comprising a carbon black dispersion and/or a dye and a silver halide photographic emulsion layer.

In the most preferred embodiment, the above-described antihalation layer contains a developing agent.

The silver halide photographic emulsion which can be used in the present invention comprises silver halides dispersed in a hydrophilic colloidal substance. The silver halides may be any of silver chloride, silver chlorobromide, silver bromide, silver iodobromide, and silver iodochlorobromide.

In order to obtain images having particularly high sharpness and high contrast, the silver halide emulsion to be used in the present invention preferably has a silver halide composition of silver chlorobromide or silver chlorobromoiodide having a bromide content of from about 0.1 to about 9 mol%, and more preferably from about 0.5 to about 5 mol%, and an iodide content of from 0 to about 0.2 mol%, and more preferably from 0 to about 0.1 mol%, with the balance being chloride. The weight ratio of the hydrophilic colloid to the silver halides (as converted to silver nitrates) in the emulsion generally ranges from about 0.1/1 to about 3.0/1, preferably from about 0.3/1 to about 2.5/1, and more preferably from about 0.5/1 to about 2.3/1.

The mean grain size of the silver halide grains which can be used in the present invention is not particularly restricted, but preferably ranges from 0.1 to 3.0 $\mu$m, and more preferably from 0.1 to 0.5 $\mu$m.

The silver halides to be used in the present invention can contain a trace amount of a heavy metal, such as rhodium, palladium, iridium, lead, nickel, copper, zinc, gold, etc. The silver halide grains can be sensitized by sulfur sensitization, gold sensitization or a combination thereof. The silver halide emulsion is usually sensitized to wavelengths of from about 530 to about 560 nm, and may further be sensitized panchromatically.

The silver halide emulsion layer and/or the image-receiving layer can contain various compounds that are typically employed for carrying out a silver salt diffusion transfer process. Such compounds include, for example, antifoggants, such as tetraazaindenes, mercaptotetrazoles, etc., coating aids, such as saponin, polyalkylene oxide derivatives, etc., hardeners, such as formalin, chromium alum, etc., plasticizers, and the like.

The support which can be used for a light-sensitive material, an image-receiving material or a so-called monosheet composed of both may be formed of any commonly employed support material, including paper, glass, films, e.g., a cellulose acetate film, a polyvinyl acetate film, a polystyrene film, a polyethylene terephthalate film, etc., metal supports coated with paper on both sides, paper supports coated with an $\alpha$-olefin polymer, e.g., polyethylene, on one or both sides, and the like.

A developing agent which can be used in the present invention may be a single compound selected from hydroquinones and 3-pyrazolidinones, but a combination of a hydroquinone and a 3-pyrazolidinone is preferably used. For example, a combination of hydroquinone and 4-hydroxymethyl-4-methyl-1-p-tolyl-3-pyrazolidinone, a combination of hydroquinone and 4-hydroxymethyl-4-methyl-1-phenyl-3-pyrazolidinone, a combination of hydroquinone and 4,4-dihydroxymethyl-1-phenyl-3-pyrazolidinone, or a combination of hydroquinone and 4,4-dihydroxymethyl-1-p-tolyl-3-pyrazolidinone can be used.

The hydroquinone is incorporated into the photographic material in an amount of from about 0.06 to about 6.3 mols, and preferably from about 0.1 to about 1.5 mols, per mol of silver, and the pyrazolidinone is incorporated in the photographic material in an amount of from about 0.006 to about 0.6 mol, and preferably from about 0.02 to about 0.16 mol, per mol of silver.

The image-receiving layer of the image-receiving material according to the present invention essentially contains gelatin and physical development nuclei, and optionally contains a hydrophilic colloid other than the water-soluble vinyl polymer or gelatin, and a color toning agent, and may further contain, if desired, a whitening agent other than the water-soluble fluorescent brightening agent, a stain-preventing agent, e.g., boric acid, a surface active agent for coating, a hardener, and the like.

The physical development nuclei which can be used in the present invention can be any conventionally known physical development nuclei, including heavy metals, e.g., zinc, mercury, lead, cadmium, iron, chromium, nickel, tin, cobalt, copper, etc.; noble metals, e.g., palladium, platinum, silver, gold, etc.; sulfides, selenides and tellurides of these metals; and the like. These physical development nucleating substances can be prepared by reducing the corresponding metal ions to form a metal colloid dispersion or mixing a metal ion solution with a solution of a soluble sulfide, selenide, or telluride to form a colloidal dispersion of a water-insoluble metal sulfide, metal selenide, or metal telluride.

Functions of the physical development nuclei in a silver transfer process are described, e.g., in U.S. Pat. No. 2,774,667. In order to obtain an image-receiving material providing a high contrast image, these physical development nuclei are incorporated in the image-receiving layer in an amount of from $10^{-10}$ to $10^{-5}$ g/cm$^2$, and preferably from $10^{-8}$ to $10^{-6}$ g/cm$^2$.

It is preferable that the development nucleus-containing image-receiving layer further contains a color toning agent.

Such a color-toning agent is conventional and preferably includes mercaptoimidazoles and mercaptotetrazoles.

The image-receiving material according to the present invention can further contain a silver halide solvent, such as potassium thiosulfate, sodium thiosulfate, etc.

A processing solution which can preferably be used for a silver salt diffusion transfer process comprises an alkaline substance, e.g., sodium hydroxide, potassium hydroxide, lithium hydroxide, sodium tertiary phosphate, etc.; a preservative, e.g., sodium sulfite, etc.; a viscosity-imparting agent, e.g., carboxymethyl cellulose, hydroxyethyl cellulose, etc.; an antifoggant, e.g., potassium bromide, etc.; a silver halide solvent, e.g., sodium thiosulfate, etc.; a color toning agent, e.g., 1-phenyl-5-mercaptotetrazole, etc.; a surface active agent, e.g., polyoxyalkylene compounds, alkylbenzenesulfonic acids, onium compounds, etc.; a development nucleus, such as those described in British Pat. No. 1,001,558; and a developing agent, such as those described above. The processing solution usually has a pH value of from about 9.5 to 15, and preferably from about 10 to 13.0, at which development can be activated. The optimum pH level can be appropriately selected according to the particularly intended use, the photograhic material used, the desired image, the types and amounts of various additives used in the processing solution.

In the present invention, a water-soluble fluorescent brightening agent is used in an image-receiving layer in a relative amount greater than usual with respect to the gelatin present in the image-receiving layer, and this tends to cause reduction in transferred density, probably due to poisoning, i.e., inactivation, of the physical development nuclei by the fluorescent brightening agent. A very significant feature of the present invention resides in the effect to prevent this reduction in transferred density.

It has also been found according to the present invention that when a processing solution containing a compound having the following formula (A) is used, the transferred density can be greatly increased without impairing the whitening effect brought about by the whitening agent.

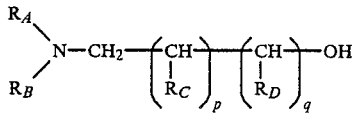

(A)

In formula (A), $R_A$ represents a hydrogen atom or a lower alkyl group containing from 1 to 4 carbon atoms, $R_B$ represents a hydrogen atom or a lower alkyl group containing from 1 to 4 carbon atoms, $R_C$ and $R_D$ each represents a hydrogen atom or a hydroxyl group, and p and q each represents 0 or 1, with proviso that p and q do not simultaneously represent 0.

The weight ratio of the water-soluble vinyl polymer to the water-soluble fluorescent brightening agent which can be used in the present invention is an important factor. If the weight proportion is not adequate, the above-described effect of the present invention cannot be produced.

The reason therefor is not clear. However, incorporation of a water-soluble fluorescent brightening agent alone in an image-receiving layer results in reduction of transferred density, and, in turn, incorporation of a water-soluble vinyl polymer, e.g., polyvinylpyrrolidone, alone in the image-receiving layer also causes similar reduction of transferred density in some cases. To the contrary, when the water-soluble fluorescent brightening agent and the water-soluble vinyl polymer are simultaneously added to the image-receiving layer in a weight ratio of from 1/0.1 to 1/5, and preferably from 1/0.5 to 1/3, an excellent whitening effect can surprisingly be produced without reduction of the transferred density.

It has hitherto been known to apply a water-soluble vinyl polymer to fluorescent brightening for purposes of increasing fluorescence intensity, prevention of elution during processing, and the like, but it was completely unexpected based on such a conventional application that the combined use of the water-soluble vinyl polymer and the fluorescent brightening agent in a silver salt diffusion transfer process in accordance with the present invention could bring about the above-described effect to thereby simultaneously achieve high transfer density and a whitening effect.

The present invention will now be illustrated in greater detail with reference to examples, but it should be understood that these examples are not to be construed as limiting the scope of the present invention.

EXAMPLES 1 TO 18

On one side of a paper support having coated polyethylene on both sides thereof and having a weight of 110 g/m$^2$, an image-receiving layer comprising gelatin containing a metal palladium nucleus and carboxymethyl cellulose was formed so that a hydrophilic colloid had a dry weight of 3 g/m$^2$. The resulting image-receiving material was designated as Sample O.

Samples A to N were prepared in the same manner except that a combination of Compound Nos. 1, 8, 22 or 26 of the water-soluble fluorescent brightening agent, a comparative fluorescent brightening agent, and polyvinylpyrrolidones (PVP) having varied molecular weight was incorporated to the image-receiving layer, as indicated in Table 1.

On the other hand, a gelatin layer containing 0.25 g/m$^2$ of carbon black for antihalation, 0.7 g/m$^2$ of hydroquinone and 0.17 g/m$^2$ of 4-hydroxymethyl-4-methyl-1-phenyl-3-pyrazolidinone was formed on the same paper support as used for the image-receiving material to a coverage of 4 g/m$^2$ as gelatin. Then, an orthochromatically sensitized gelatin-silver chlorobromide emulsion layer containing 2.0 g/m$^2$ (as converted to silver nitrate) of silver chlorobromide (Br content: 2 mol%) having a mean grain size of 0.3 μm was further provided on the antihalation layer to prepare a light-sensitive material.

The resulting light-sensitive material was exposed to light through a gradient wedge for sensitometry. Then, the image-receiving layer of the above-prepared image-receiving material and the emulsion layer of the exposed light-sensitive material were contacted to each other and passed through a processing solution for silver salt diffusion transfer having the following composition at 23° C. After passing through squeezing rollers, the two sheets were allowed to stand for 30 seconds, and then separated. The image-receiving material was washed with water for 5 minutes and dried in air. The transferred density of the sample was determined by measuring the transmittance density (i.e., maximum density of the transferred image excluding the support.) Further, the white area was determined for fluorescence intensity at about 440 nm by means of Hitachi Color Analyzer-607, manufactured by Hitachi, Ltd. The results obtained are shown in Table 1.

| Component | Composition of Processing Solution: Solution I | Solution II | Solution III |
|---|---|---|---|
| Water | 800 ml | 800 ml | 800 ml |
| $Na_3PO_4.12H_2O$ | 75 g | 75 g | 75 g |
| $Na_2SO_3$ | 40 g | 40 g | 40 g |
| KBr | 0.5 g | 0.5 g | 0.5 g |
| $Na_2S_2O_3$ | 20 g | 20 g | 20 g |
| 1-Phenyl-5-mercapto-tetrazole | 70 mg | 70 mg | 70 mg |
| Amine compound of formula (A)* | | | |
| 1 | 10 g | — | — |
| 2 | — | 10 g | — |
| 3 | — | — | 10 g |
| Water to make 1,000 ml | | | |

*Compound 1: $CH_3—NHCH_2CH_2OH$
Compound 2: $NH_2CH_2CH_2CH_2OH$
Compound 3: 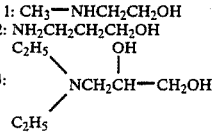

TABLE 1

| Example No. | Sample No. | Compound No. of Brightening Agent (amount: mol/m²) | M.W. of PVP | PVP/Brightening Agent Weight Ratio | Amine Compound (A) | Transferred Density | Fluorescent Intensity (relative value) | Remarks |
|---|---|---|---|---|---|---|---|---|
| 1 | A | 8 ($1.3 \times 10^{-4}$) | 9,000 | 1.0/1 | 1 | 2.30 | 0.1 | Comparison |
| 2 | B | 8 " | 50,000 | " | 1 | 2.70 | 0.8 | Invention |
| 3 | C | 8 " | 160,000 | " | 1 | 2.85 | 1.0 | " |
| 4 | D | 8 " | 350,000 | " | 1 | 2.80 | 0.9 | " |
| 5 | E | 8 " | 160,000 | 0.05/1 | 1 | 2.20 | 0 | Comparison |
| 6 | F | 8 " | " | 0.1/1 | 1 | 2.60 | 0.6 | Invention |
| 7 | G | 8 " | " | 2.0/1 | 1 | 2.80 | 1.0 | " |
| 8 | H | 8 " | " | 5.0/1 | 1 | 2.70 | 0.9 | " |
| 9 | I | 8 " | " | 10.0/1 | 1 | 2.10 | 0.8 | Comparison |
| 10 | C | 8 " | " | 1.0/1 | 2 | 2.85 | 1.0 | Invention |
| 11 | " | 8 " | " | " | 3 | 2.83 | 1.0 | " |
| 12 | J | 1 " | " | " | 1 | 2.85 | 1.0 | " |
| 13 | K | 22 " | " | " | 1 | 2.83 | 0.9 | " |
| 14 | L | 26 " | " | " | 1 | 2.84 | 0.9 | " |
| 15 | M | Comparative Agent 1 " | " | " | 1 | 2.80 | 0.4 | Comparison |
| 16 | N | 8 " | " | No PVP added | 1 | 2.40 | 0 | " |
| 17 | O | None | — | — | 1 | 2.85 | 0 | " |

1 Comparative Fluorescent Brightening Agent:

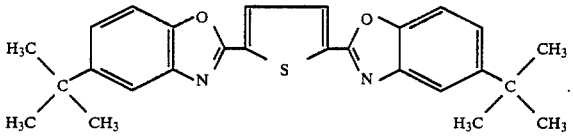

As is apparent from Table 1, it can be seen that the samples according to the present invention produced high transferred density without being accompanied by reduction of whiteness.

While the invention has been described in detail and with reference to specific embodiments thereof, it will be apparent to one skilled in the art that various changes and modifications can be made therein without departing from the spirit and scope thereof.

What is claimed is:

1. A process of forming an image, comprising:

imagewise exposing and development processing a silver salt diffusion transfer photographic material;

said silver salt diffusion transfer photographic material comprising a light-sensitive material containing a silver halide photographic emulsion layer and an image-receiving material comprising a support having provided thereon an image-receiving layer containing physical development nuclei;

said image-receiving layer containing gelatin, a water-soluble fluorescent brightening agent, and a water-soluble vinyl polymer having an average molecular weight of from about 10,000 to about 450,000, wherein the weight ratio of the water-soluble fluorescent brightening agent to the gelatin ranges from about 0.02/1 to about 0.5/1 and the weight ratio of the water-soluble vinyl polymer to the water-soluble fluorescent brightening agent ranges from about 0.1/1 to about 5/1; and development processing said silver salt diffusion transfer photographic material with a processing solution containing an amine compound shown by formula (A);

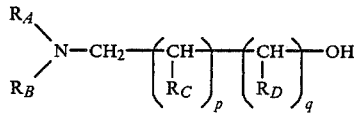

(A)

wherein $R_A$ represents a hydrogen atom or a lower alkyl group containing from 1 to 4 carbon atoms, $R_B$ represents a hydrogen atom or a lower alkyl group containing from 1 to 4 carbon atoms, $R_C$ and $R_D$ each represents a hydrogen atom or a hydroxyl group, and p and q each represents 0 to 1, with the proviso that p and q do not simultaneously represent 0, wherein the water-soluble vinyl polymer is polyvinyl pyrrolidone, a copolymer of vinyl pyrrolidone and vinyl acetate, or a copolymer of

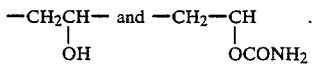

2. A process as in claim 1, wherein the water-soluble fluorescent brightening agent is represented by formula (I), (II) or (III):

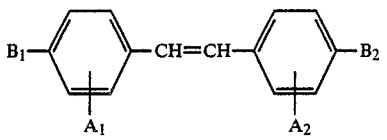

(I)

wherein $A_1$ and $A_2$ each represents a hydrogen atom, a lower alkyl group, a hydroxyl group, a carboxyl group or a salt thereof, or a sulfonic acid group or a salt thereof, and $B_1$ and $B_2$ each represents a hydrogen atom, a group of the formula

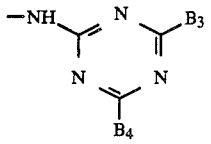

wherein $B_3$ and $B_4$ each represents a hydrogen atom, a hydroxyl group, a lower alkoxy group, an aryloxy group, a heterocyclic group, a lower alkylthio group, an arylthio group, a thioheterocyclic group, or a substituted or unsubstituted amino group wherein the substituent is a sulfoalkyl group, a sulfoaryl group or a hydroxyalkyl group, a group of the formula —NHCOB$_5$, wherein $B_5$ represents a lower alkoxy group, a substituted or unsubstituted aryl group wherein the substituent is an amino group or an alkoxy group, an aryloxy group, a heterocyclic group, a lower alkylthio group, a thioheterocyclic group, or a substituted or unsubstituted amino group wherein the substituent is an aryl group, or a group of the formula

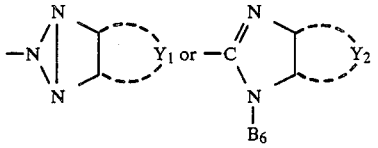

wherein $Y_1$ and $Y_2$ each represents a non-metallic atomic group forming a substituted or unsubstituted aromatic ring wherein the substituent is a sulfo group, a hydroxy group or an alkyl group, and $B_6$ represents a hydrogen atom or a substituted or unsubstituted lower alkyl group wherein the substituent is a hydroxy group;

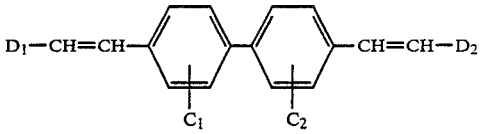

(II)

wherein $C_1$ and $C_2$ each represents a hydrogen atom, a lower alkyl group, a lower alkoxy group, a halogen atom, a sulfonic acid group or a salt thereof, or a carboxyl group or a salt thereof; and $D_1$ and $D_2$ each represents a substituted or unsubstituted diphenyl group wherein the substituent is a sulfo group, an α-naphthyl group, a β-naphthyl group, or a group of the formula

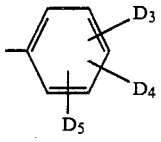

wherein $D_3$ represents a hydrogen atom, a sulfonic acid group or a salt thereof, or a carboxyl group or a salt thereof, $D_4$ represents a hydrogen atom, a halogen atom, a lower alkyl group, or a lower alkoxy group, and $D_5$ represents a hydrogen atom or a lower alkyl group;

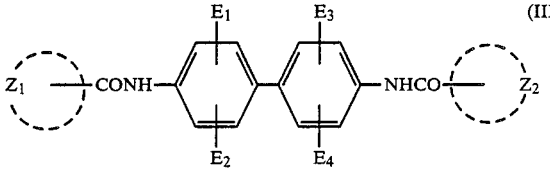

(III)

wherein $E_1$, $E_2$, $E_3$ and $E_4$ each represents a hydrogen atom, a halogen atom, a hydroxyl group, a carboxyl group or a salt thereof, a sulfonic acid group or a salt thereof, a lower alkyl group, or a lower alkoxy group, and $Z_1$ and $Z_2$ each represents a non-metallic atomic group forming a substituted or unsubstituted aromatic ring wherein the substituent is a hydroxy group, a sulfo group, a carboxyl group or an alkoxy group.

3. A process as in claim 1, wherein the water-soluble fluorescent brightening agent is represented by formula (IV) or (V):

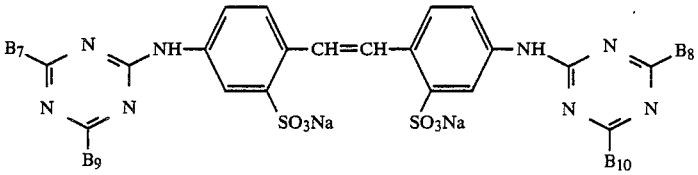

(IV)

wherein $B_7$, $B_8$, $B_9$ and $B_{10}$ each represents —NHC$_6$H$_5$, —NHC$_6$H$_5$SO$_3$Na, —OH, —NH$_2$, —NHCH$_2$CH$_2$SO$_3$Na, —OCH$_2$CH$_2$OH, or —OCH$_3$;

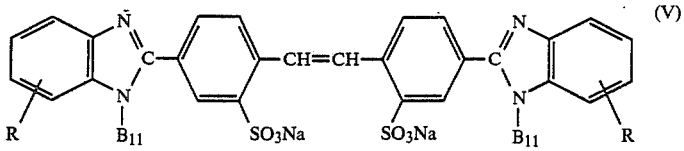

(V)

wherein R represents —H, —$CH_3$, —$C_2H_5$, —$OCH_3$, or —$SO_3Na$, and $B_{11}$ represents —H, —$CH_3$, or —$CH_2CH_2OH$.

4. A process as in claim 1, wherein the water-soluble fluorescent brightening agent is represented by formula (VI):

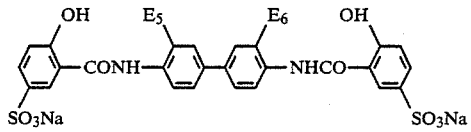

(VI)

wherein $E_5$ and $E_6$ each represents —H, —$CH_3$, or —$OCH_3$.

5. A process is claimed in claim 1, wherein said compound represented by the formula (A) is $NH_2CH_2CH_2CH_2OH$.

6. A process as in claim 1, wherein the water-soluble vinyl polymer has an average molecular weight of from about 50,000 to about 450,000.

7. A process as in claim 1, wherein the water-soluble vinyl polymer has an average molecular weight of from about 100,000 to about 450,000.

8. A process as in claim 1, wherein the water-soluble vinyl polymer is polyvinylpyrrolidone.

9. A process as in claim 1, wherein the weight ratio of the water-soluble fluorescent brightening agent to the gelatin ranges from about 0.02/1 to about 0.3/1.

10. A process as in claim 1, wherein the weight ratio of the water-soluble vinyl polymer to the water-soluble fluorescent brightening agent ranges from about 0.1/1 to about 0.5/1.

11. A process as in claim 8, wherein the weight ratio of the polyvinylpyrrolidone to the water-soluble fluorescent brightening agent ranges from about 0.5/1 to about 3/1.

12. A process as claimed in claim 1, wherein said light-sensitive material further comprises a support having formed thereon an antihalation layer comprising at least one of a carbon black dispersion and a dye.

13. A process as claimed in claim 12, wherein said antihalation layer contains a developing agent.

14. A process of forming an image as claimed in claim 1, wherein said compound represented by the formula (A) is $CH_3$—$NHCH_2CH_2OH$, $NH_2CH_2CH_2CH_2OH$, or $(C_2H_5)_2NCH_2CH(OH)$—$CH_2OH$.

* * * * *